US010415560B2

(12) United States Patent
Choi et al.

(10) Patent No.: US 10,415,560 B2
(45) Date of Patent: Sep. 17, 2019

(54) DUAL-HEAD, PULSELESS PERISTALTIC-TYPE METERING PUMP

(71) Applicants: Nelson Naksun Choi, San Jose, CA (US); Steve Lim Choi, San Jose, CA (US)

(72) Inventors: Nelson Naksun Choi, San Jose, CA (US); Steve Lim Choi, San Jose, CA (US)

(73) Assignee: Nelson Naksun Choi, San Jose, CA (US)

( * ) Notice: Subject to any disclaimer, the term of this patent is extended or adjusted under 35 U.S.C. 154(b) by 299 days.

(21) Appl. No.: 15/141,278

(22) Filed: Apr. 28, 2016

(65) Prior Publication Data

US 2017/0314545 A1 Nov. 2, 2017

(51) Int. Cl.
*F04B 43/12* (2006.01)
*F04B 43/00* (2006.01)

(52) U.S. Cl.
CPC ..... *F04B 43/1292* (2013.01); *F04B 43/0072* (2013.01); *F04B 43/1215* (2013.01); *F04B 43/1238* (2013.01); *F04B 43/1276* (2013.01)

(58) Field of Classification Search
CPC ..... F04B 43/1253; F04B 43/1276; F04B 43/1284; F04B 43/1292; F04B 43/1238; F04B 45/08; F04B 11/005; F04B 11/0091; F04B 43/1215
See application file for complete search history.

(56) References Cited

U.S. PATENT DOCUMENTS

| | | | | | |
|---|---|---|---|---|---|
| 2,414,355 | A * | 1/1947 | Bogoslowsky | F04B 43/0072 | 138/118 |
| 4,231,725 | A * | 11/1980 | Hogan | F04B 43/1284 | 417/477.11 |
| 4,631,007 | A * | 12/1986 | Olson | F04B 43/1253 | 417/476 |
| 4,834,630 | A * | 5/1989 | Godwin | F04B 43/12 | 417/475 |
| 5,759,017 | A * | 6/1998 | Patton | F04B 43/1253 | 417/477.11 |
| 5,846,061 | A * | 12/1998 | Ledebuhr | F04B 43/1292 | 417/477.9 |
| 8,152,498 | B2 * | 4/2012 | Bunoz | F04B 43/1253 | 417/269 |
| 2005/0238516 | A1 * | 10/2005 | Kent | F04B 43/1292 | 417/477.8 |
| 2015/0198153 | A1 * | 7/2015 | Gledhill, III | F04B 43/1292 | 417/53 |

* cited by examiner

*Primary Examiner* — Bryan M Lettman
(74) *Attorney, Agent, or Firm* — Ray K. Shahani, Esq.

(57) ABSTRACT

A dual-head, pulseless peristaltic-type pump comprises a pump housing, cover, two compressible tube chambers and two sets of rotatable occluding members. An off-center drive axis driven by motor or other rotational mechanism rotate inner large diameter disk. Balls or rollers between inner disk rotate in one direction from center drive axis where the outer ring is stationary and occludes the tube by linear motion without friction between tube and outer ring. The linear roller occluding motion transfers liquid or slurry from inlet to outlet of tube. In one embodiment, two separate sets of occluding members are installed 180 degree opposite to each other such that pulsations are compensated for and canceled out.

5 Claims, 10 Drawing Sheets

SECTION A - A

DUAL-HEAD, PULSELESS PERISTALTIC-TYPE METERING PUMP

RELATED APPLICATIONS

None

FIELD OF THE INVENTION

The present invention is related to pulseless, positive displacement fluid/slurry/gas peristaltic pumps.

BACKGROUND OF THE INVENTION

Peristaltic pumps are used to transfer liquids, gel, and semi-solids in many industries worldwide. These pumps have many advantages over other pumping methodologies such as they are easy to setup, and allow minimal contamination of transferred materials. Peristaltic pumps operate by squeezing elastic tubing in one direction. The repeated discharge and vacuum of the fluid to be transferred moves the fluid.

The peristaltic pump was designed to prevent contamination because no contact with the material being transferred is made with the exterior of the tubing. Existing peristaltic pump technologies also have a common set of problems: non-steady flow or pulsations, high flexible tube wear, high maintenance costs and not highly accurate metering of pumped volumes. The pump design of the present invention addresses these issues with new head designs that minimize these issues by using new materials and tube routing. A single roller manufactured with unique nonmetallic materials increases pump efficiency and minimizes tube wear. The tube layout minimizes pulsation and enables precise metering of pumped materials.

Back pressure is generated in the area where two tubes are pinched by rollers. This is the problem of pulsation that can damage fittings, piping and other system components connected at the output line. This pinched area makes dose control difficult. When rollers rotate in one direction, tension in the tube hose is forced to accumulate in one direction. This results in the problem of shorter lifetime of hose sections. In addition, friction between hose and roller is one of the factors that reduce lifetime of hose during operation. In addition, metal cast rollers with high thermal conductivity can damage the hose by the heat of friction. In addition, more energy and speed is required to drive a big outer roller by smaller inner bearings.

The amount of squeeze applied to the tubing affects pumping performance and the tube life—more squeezing decreases the tubing life dramatically, while less squeezing can cause the pumped medium to slip back, especially in high pressure pumping, and decreases the efficiency of the pump dramatically and the high velocity of the slip back typically causes premature failure of the hose. Therefore, this amount of squeeze becomes an important design parameter.

Increasing the number of rollers doesn't increase the flow rate, instead it will decrease the flow rate somewhat by reducing the effective (i.e. fluid-pumping) circumference of the head. Increasing rollers does tend to decrease the amplitude of the fluid pulsing at the outlet by increasing the frequency of the pulsed flow.

The length of tube (measured from initial pinch point near the inlet to the final release point near the outlet) does not affect the flow rate. However, a longer tube implies more pinch points between inlet and outlet, increasing the pressure that the pump can generate.

The bar is a metric (but not SI) unit of pressure, defined by the IUPAC as exactly equal to 100,000 Pa. It is about equal to the atmospheric pressure on Earth at sea level, and since 1982 the IUPAC has recommended that the standard for atmospheric pressure should be harmonized to 100,000 Pa=1 bar 750.0616827 Torr. The same definition is used in the compressor and the pneumatic tool industries (ISO 2787).

The main issues with existing designs are as follows:

1. Existing rollers/shoes element scrub the transfer tube with forces that stretch the tube and require the tube to be anchored to the pump housing to keep it from migrating out of the pump head.

2. Existing rollers/shoes element design requires frequent lubrication due to friction. It causes friction and heat generation, eventually leading to maintenance and replacement.

3. Existing transfer a pulsation energy to the tube anchors and downstream components of the system that cause stress and eventual wear. This is caused by the pump occluding mechanism where the rollers/shoes element loses contact with the tube. This results in a pressure release. When the roller regains contact with the tube, a pressure increase occurs causing significant pulsing of the material flow and tubing vibration.

4. Tube stretching changes the inner diameter of the tube which changes the material volume through the tube. Periodically the pump must be calibrated to compensate for this varied tube shape.

In U.S. Pub. No. US2006/024596, a compensating volume of fluid is defined between occluding members, but nothing prevents pulsation between loop input and output and fluid input port and output port. The use of 3 members still create 3 pulsations when occluded. Their design of occluding members permit friction between occluding members and tube. This stretches the tube, and changes it's shape resulting in changed volume. This is unacceptable in applications that require maintaining a constant volumetric flow rate. In addition, many components are used in this complicated structure, giving rise to a higher potential for mechanical failure caused by wear. The system also needs frequent lubrication of the numerous moving parts. Finally, a complicated design of drive assembly makes it difficult to replace tube that, increasing maintenance time and cost.

In US Pub. No US2012/0156074, the stator and rotor does not eliminate friction, therefore the use of hose clamps at the inlet and outlet prevent tube slippage. However, during continuous rotation of the pump, the tube will be stretched and made thinner at the side of the tube. Also this patent does not address the 3 pulsations by 3 rotors and wide pulsation between pump input hose and output hose.

In U.S. Pat. No. 8,858,201, a rotary push plate is arranged for facilitating fluid flow inside the elastic tube from an inlet to an outlet by pushing a plurality of push pins sequentially. This may prevent friction caused by rotation motion. However, a major drawback of this invention is that the complicated mechanism is created using many moving, wearable parts that increase the likelihood of potential mechanical failure and increase cost of maintenance.

SUMMARY OF INVENTION AND ADVANTAGES

Peristaltic pumps are used to transfer liquids, gel, and semi-solids in many industries worldwide. These pumps have many advantages over other pumping methodologies such as they are easy to set up, and allow only minimal contamination of the transferred material. Existing peristaltic pump technology also has common problems: non-steady flow or flow pulsations, high degree of flexible tube wear, high maintenance cost and inaccurate metering. The pump design of the present invention addresses and minimizes these issues with a new housing and roller element design that uses new materials and a new design for the tube routing path. The roller element is manufactured with unique, non-metallic materials that increase pump efficiency and minimize tube wear. The tube layout minimizes pulsation and enables precise metering of pumped materials. A pump with a single head incorporating the invention of the present invention has considerably improved performance compared to the fluid pumps of the prior art. Furthermore, by placing two pump housings into one body installed with a 180 degree phase difference between each other, pulsation is compensated for and eliminated.

Minimizing the number of components reduces the cost of maintenance. The present invention minimizes the stress applied to the tube by rolling the roller across the tube with less stretching force. The tube is routed inside the pump housing against an inside wall with a flexible tension absorption section. This acts as a buffering space that allows the tube to move under roller contact and return after the roller releases the tension in the tube section.

The single roller element race design uses ball of ceramic materials that do not need lubrication and create less friction. The single roller element race design incorporates a tube overlap area to allow constant tube to occlude contact. This maintains tube pressure and minimizes transfer of pulsation energy. The single roller element race minimizes the change in tube diameter. Pump volumes or volumetric flow rates are maintained for longer periods of time and pump calibration requirements are minimized Reduced mechanical friction results in less heat generation and reduces power requirements of the pump. The single roller element race materials act as heat insulators and do not transfer heat to or from the pumped material. This results in easier temperature management of the pumped materials.

The single ring roller designed pump can be scaled from microliter flow rates up to multi-liter flow rates. This is achieved by using a large radial race setup and by transfer of an occluding force using balls or rollers that hold the tubing less rigidly than designs of the prior art. The tube does not need to be held by rigid anchoring systems. As will be recognized by those skilled in the art, this feature eliminates the typical case where the tubing slips from one side to the other due to the tube being dragged by friction caused by the rollers.

The pulseless metering pump of the present invention has less components and reduces cost of spare parts and preventive maintenance. Utilizing a full loop 360 degree type design, the pump of the present invention generates higher flow rates, longer tube lifetime and savings of energy needed to drive the pump. Tube replacement is easy. In addition, no external components such as pulsation damper, check-valve or cut-off valve is necessary. It will be understood that a reduced mechanical pump friction and heat generation reduces power requirements of the pump. Smaller motors can be used to pump small volumes or pump at lower pressures compared to existing pump designs.

The new roller materials act as heat insulators and do not transfer heat to or from the pumped material. This results in easier temperature management of the pumped materials.

The present invention utilizes a square type shaft. This makes it possible for the shaft to secure the bearing. This increases efficiency of transfer of rotational energy from the motor to the inner rotating element.

The roller element contains an outer race design. It uses balls or roller, is inner and has a square shape key hole.

An "L" shape casing makes it easy to load or replace the tube. It is also possible to hold extra buffer. A vibration buffer spring reduces the vibration. This can be understood by consideration of the laws of physics called Bernoulli's principle. Bernoulli's principle states that an increase in the speed of a fluid occurs simultaneously with a decrease in pressure or a decrease in the fluid's potential energy. See: http://hyperphysics.phy-asir.gsu.edu/bbase/pber.html. The amount of squeeze applied to the tubing affects pumping performance and the tube life—more squeezing decreases the tubing life dramatically, while less squeezing can cause the pumped medium to slip back, especially in high pressure pumping, and decreases the efficiency of the pump dramatically and the high velocity of the slip back typically causes premature failure of the hose. Therefore, this amount of squeeze becomes an important design parameter. See: http://en.wikipedia.org/wiki/Peristaltic_pump#Applications. Increasing the number of rollers doesn't increase the flow rate, instead it will decrease the flow rate somewhat by reducing the effective (i.e. fluid-pumping) circumference of the head. Increasing rollers does tend to decrease the amplitude of the fluid pulsing at the outlet by increasing the frequency of the pulsed flow. The length of tube (measured from initial pinch point near the inlet to the final release point near the outlet) does not affect the flow rate. However, a longer tube implies more pinch points between inlet and outlet, increasing the pressure that the pump can generate. The bar is a metric (but not SI) unit of pressure, defined by the IUPAC as exactly equal to 100,000 Pa. It is about equal to the atmospheric pressure on Earth at sea level, and since 1982 the IUPAC has recommended that the standard for atmospheric pressure should be harmonized to 100,000 Pa=1 bar≈750.0616827 Torr. The same definition is used in the compressor and the pneumatic tool industries (ISO 2787). See: http://en.wikipedia.org/wiki/Bar_(unit).

There is also a tube buffering area inside of the casing. This provides tension buffering and provides valve function at the dual layer tubing area. This results in short pulsation time and reduced tube stretch.

In general, the improvements provided by this invention include longer lifetime of tube, and the pump is scalable, i.e., it is easy to build a pump that delivers microliters to mega-liters of fluid, using a pump with the same shape but of different sizes operating on the same concept. Double pressure and flow rate is achieved by use of a compact single body, single or dual chamber design.

Benefits and features of the invention are made more apparent with the following detailed description of a presently preferred embodiment thereof in connection with the accompanying drawings, wherein like reference numerals are applied to like elements.

BRIEF DESCRIPTION OF THE DRAWINGS

FIG. 3-1 is a representative view of the friction and drag forces imparted to the flexible tube in the metering pumps of the prior art.

FIG. 4-1 is a graphical illustration showing the elimination pulsation from the dual-head, pulseless peristaltic-type metering pump 100 of the present invention.

FIG. 4-2 is a graphical illustration showing pulsation from the metering pumps of the prior art.

FIG. 4-3 are the graphed results of experimental data collected from the dual-head, pulseless peristaltic-type metering pump 100 of the present invention.

DETAILED DESCRIPTION OF THE PREFERRED EMBODIMENT

Figure 1:
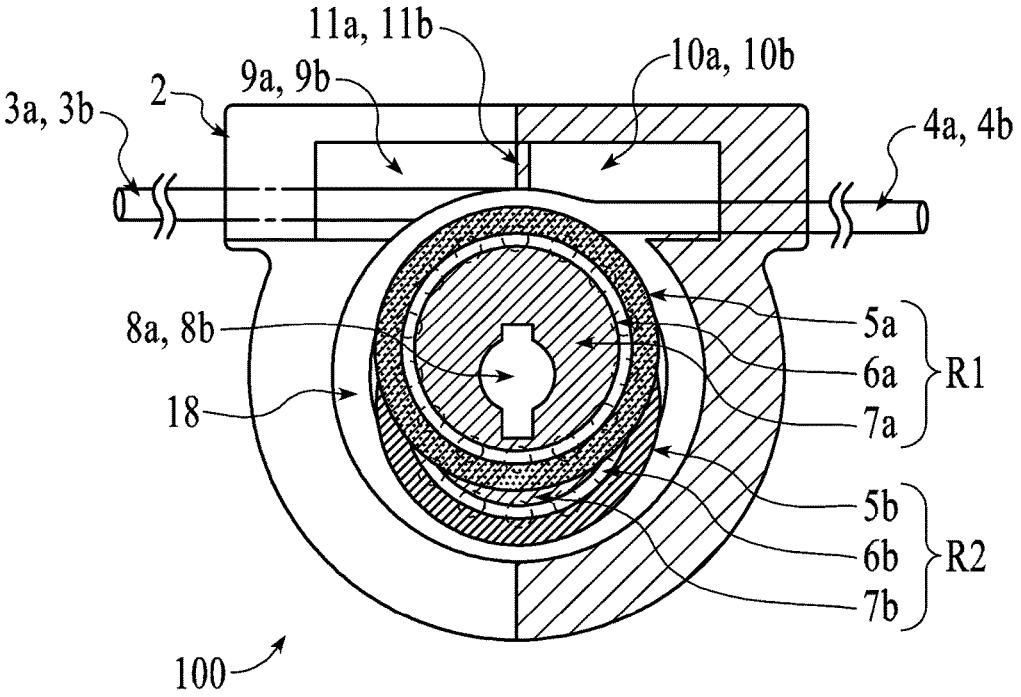
FIG. 1 is a front view of the dual-head, pulseless peristaltic-type metering pump 100 of the present invention.

The description that follows is presented to enable one skilled in the art to make and use the present invention, and is provided in the context of a particular application and its requirements. Various modifications to the disclosed embodiments will be apparent to those skilled in the art, and the general principals discussed below may be applied to other embodiments and applications without departing from the scope and spirit of the invention. Therefore, the invention is not intended to be limited to the embodiments disclosed, but the invention is to be given the largest possible scope which is consistent with the principals and features described herein.

The following is a list of reference numerals and associated elements of the dual-head, pulseless peristaltic-type metering pump of the present invention.

Figure 2:
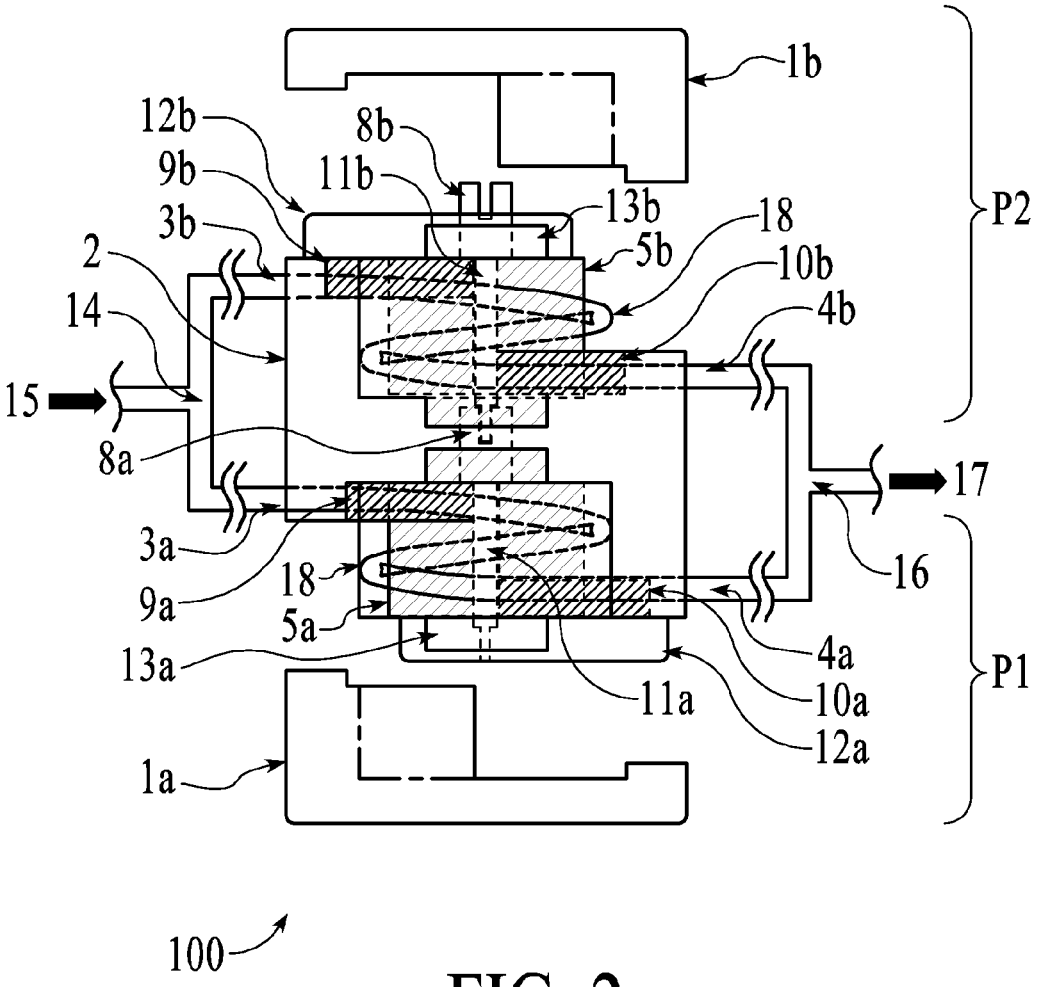
FIG. 2 is a top view of the dual-head, pulseless peristaltic-type metering pump 100 of the present invention.
Figure 3:
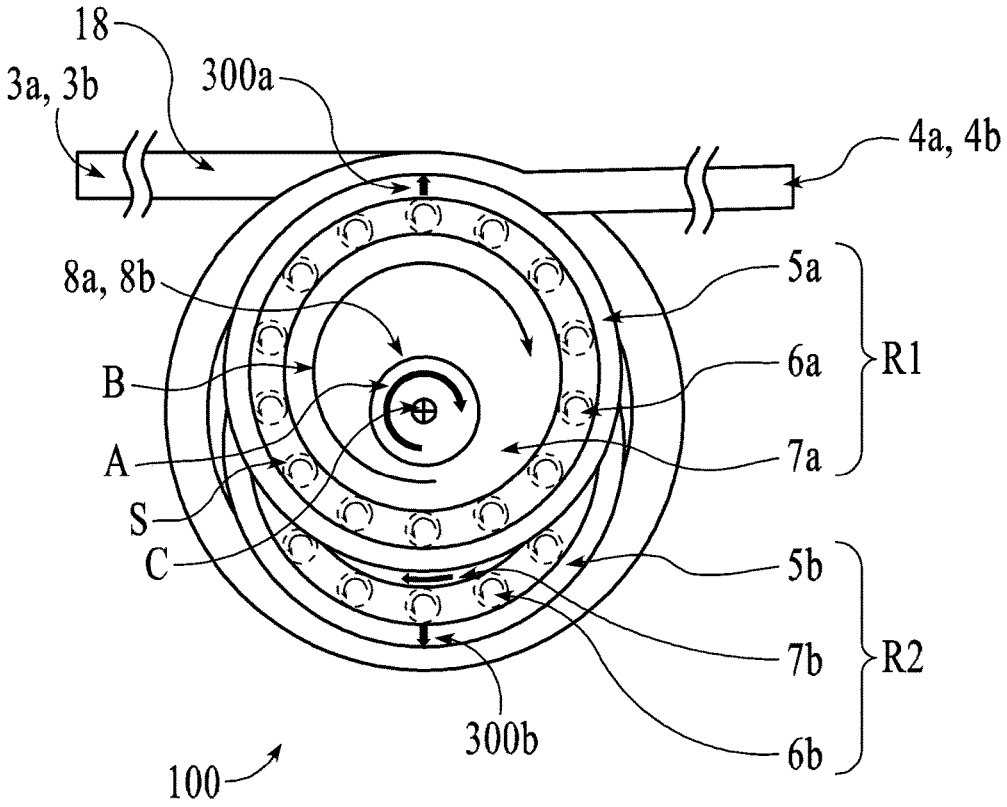
FIG. 3 is a detail view of the dual-head, pulseless peristaltic-type metering pump 100 of the present invention.
Figures 1, 3:
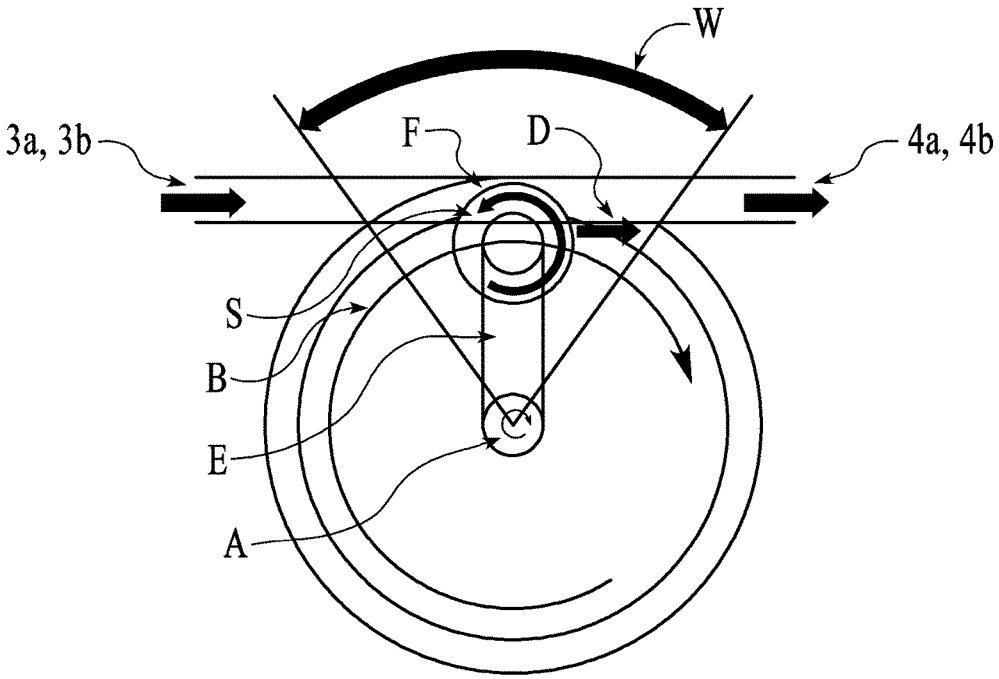
FIG. 3-1 (PRIOR ART)

1*a*, 1*b* Cover
2 Main body
3*a*, 3*b* Tube input
4*a*, 4*b* Tube output
5*a*, 5*b* Outer race roller element
6*a*, 6*b* Ball bearings or other roller elements
7*a*, 7*b* Inner roller element
8*a*, 8*b* Shaft
9*a*, 9*b* Input buffering space
10*a*, 10*b* Output buffering space
11*a*, 11*b* Dual occluding frame
12*a*, 12*b* Bearing holding element
13*a*, 13*b* Shaft fastener bearing
14 Common input port manifold
15 Input
16 Common output port manifold
17 Output
18 Flexible Tube
R1 Roller element Assembly 1
R2 Roller element Assembly 2
300*a*, 300*b* Straight load force
P1 First pump housing
P2 Second pump housing
201*a* 201*b*, 202, 203, 204, and 205 Rotation angle
W Pulsation width
C Off-center axis
A Center of drive axis radial
E Arm
B Large radius
S Small radius
D Drag force
W Pulsation angle
F Rollers or occluding shoes FIG. 1 is a front view of the dual-head, pulseless peristaltic-type metering pump 100 of the present invention. FIG. 2 is a top view of the dual-head, pulseless peristaltic-type metering pump 100 of the present invention. FIG. 3 is a detail view of the dual-head, pulseless peristaltic-type metering pump 100 of the present invention. Roller element assemblies R1, R2 that uses ball bearings or other roller elements 6*a*, 6*b* to maintain separation between the inner roller elements 7*a*, 7*b* and outer race roller elements 5*a*, 5*b*. Opposing cover portions 1*a* and 1*b* are designed with an L-shape and have half-round surfaces to guide the flexible tube 18. This L-shape design makes it easy to replace tube 18. Main body portion 2 has two identical pumping chambers. Inputs 3*a*, 3*b* and outputs 4*a*, 4*b* from each chamber are combined by common input port manifold 14 and common output port manifold 16. These common port manifolds 14 and 16 compensate for the pulsation of each side individually by the 180 degree difference in the phase of the pumps. Finally input 15 and output 17 are stable, volumetric flow rate controlled without pulsation.

Inner roller elements 7*a*, 7*b*, ball bearings or other roller elements 6*a*, 6*b* and outer race roller elements 5*a*, 5*b* are made of ceramic, polyether ether ketone (PEEK) thermoplastic polymer or other comparable material having low thermal conductivity and amenable to application of a fine surface finish. These features of the inner roller elements 7*a*, 7*b*, ball bearings or other roller elements 6*a*, 6*b* and outer race roller elements 5*a*, 5*b* improve the flexible tube 18 lifetime that by reducing damage caused by heat and friction between hose 18 and outer race roller elements 5*a*, 5*b*. Ceramic bearings require no lubrication which reduces maintenance time and cost. This wide single bearing mechanism reduces drive and motor loading. Therefore, smaller motors that use less energy can be used to drive the dual-head, pulseless peristaltic-type metering pump 100 of the present invention.

Center shafts 8*a*, 8*b* are designed with a combination of round and square shaped portions. This makes them easy to couple two roller element assemblies R1 and R2 together. The center shafts 8*a*, 8*b* are driven by a single motor or other drive mechanism to rotate center shafts 8*a*, 8*b* in a clockwise (CW) or counterclockwise (CCW) direction. Flexible tube input ports 3*a*, 3*b* and tube output ports 4*a*, 4*b* are used as inlet or outlet, depending upon the rotation of shaft 8*a*, 8*b* in a CW or a CCW direction. Shaft fastener bearings 13*a*, 13*b* are mounted in the bearing holding elements 12*a*, 12*b*. Most loop-type prior art peristaltic pumps are designed such that one of the shaft fastener bearing are mounted into cover or use only single side. If only a single bearing is used, the bearing has heavy loading during shaft rotation, and even if mounted onto the pump cover it has the potential to change from a center position. However, the shaft bearing holding elements 12*a*, 12*b* secure the shaft fastener bearings 13*a*, 13*b* that prevent centering problems and provide more robust operation.

The purpose of using ball bearings or other roller elements 6*a*, 6*b* is to reduce the forces of rotational friction and support radial and axial loads. When the inner roller elements 7*a*, 7*b* rotate with center shaft 8*a*, 8*b*, they cause the ball bearings or other roller elements 6*a*, 6*b* to rotate as well. Because the ball bearings or other roller elements 6*a*, 6*b* are rolling they have a much lower coefficient of friction than if two flat surfaces were sliding against each other. Therefore, the ball bearings or other roller elements 6*a*, 6*b* do not need lubricant. The ball bearings or other roller elements 6*a*, 6*b* tend to have lower load capacity due to a smaller contact area between the inner roller elements 7*a*, 7*b* and the outer race roller elements 5*a*, 5*b*.

The dual-head, pulseless peristaltic-type metering pump 100 of the present invention also transfers a straight load force 300*a*, 300*b* in a direction perpendicular to the central axis C of shaft portions 8*a*, 8*b*. Outer race roller elements 5*a*, 5*b* come into contact with flexible tube 18 and impart a linear occluding motion to the flexible tube 18 at tube inputs 3*a*, 3*b* and at tube outlets 4*a*, 4*b*. Thus, the peristaltic pump 100 of the present invention uses less energy to cause the occlusion of flexible tube 18. The off-center axis C of inner roller elements 7*a*, 7*b* results in a large radius of motion resulting in the occluding of the flexible tube 18 at the tubing inputs ports 3*a*, 3*b* and tubing output ports 4*a*, 4*b*. Also, roller element assemblies R1, R2 are made by nonmetallic components which are washable and protect against corrosion. Minimizing the number of moving parts all formed using robust materials saves maintenance cost and increase the mean time between failure (MTBF). When shaft portions 8*a*, 8*b* rotate in one direction, either CW or CCW, ball bearings or other roller elements 6*a*, 6*b* rotate in the opposite direction. The opposing rotation makes outer race roller element 5*a*, 5*b* essentially stationary. This motion transfers a straight load force 300*a*, 300*b* by small contact as above described. When off-center axis 8*a*, 8*b* rotates, then outer race roller elements 5*a*, 5*b* transfer straight force 300*a*, 300*b* to the tube 18 by linear occlusion motion.

Figure 4:
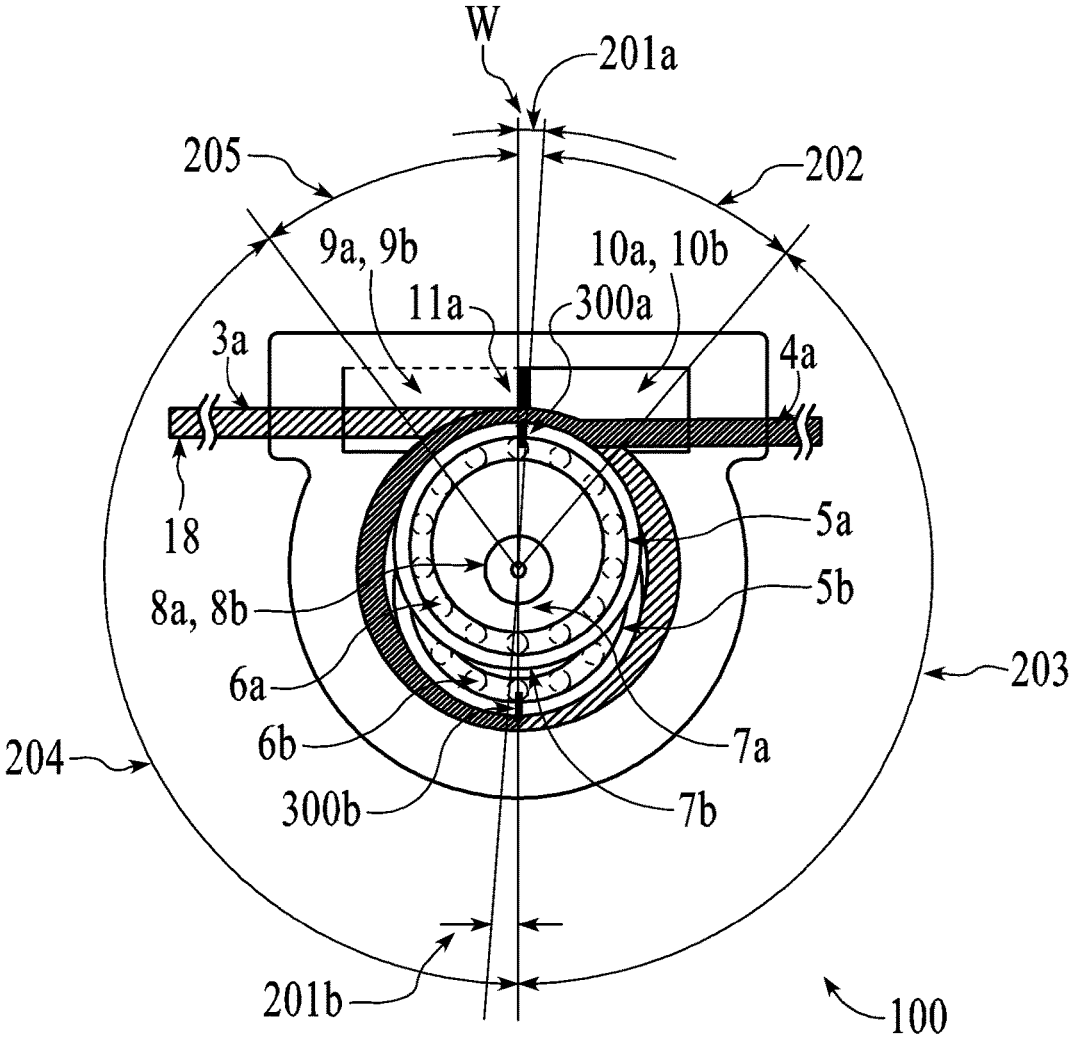
FIG. 4 is a representative view showing the elimination pulsation from the dual-head, pulseless peristaltic-type metering pump 100 of the present invention.
Figures 1, 4:
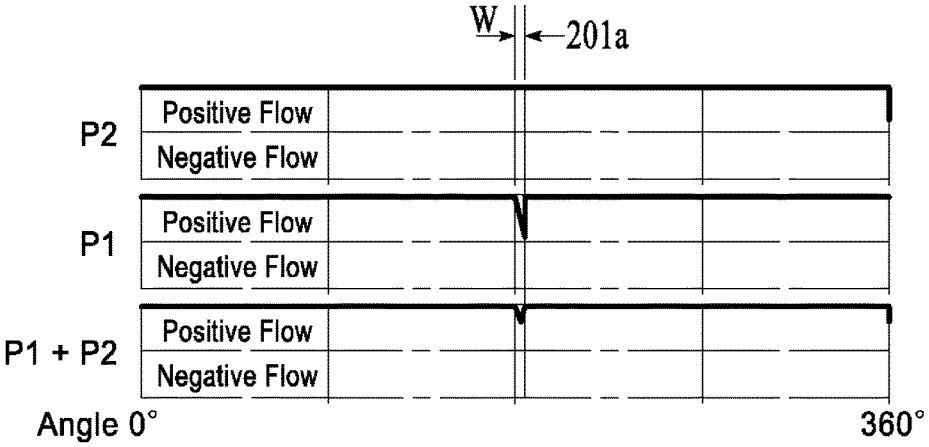
Figures 2, 4:
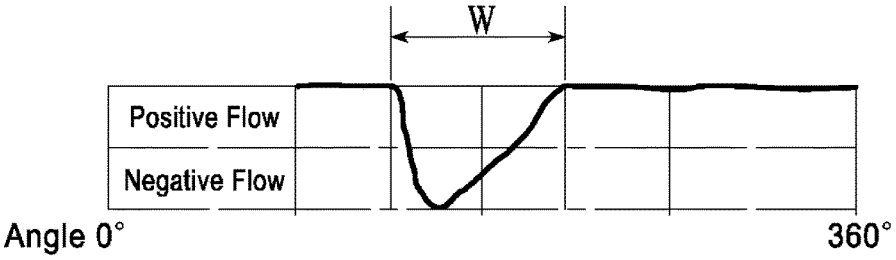
FIG. 4-2 (PRIOR ART)
Figures 3, 4:
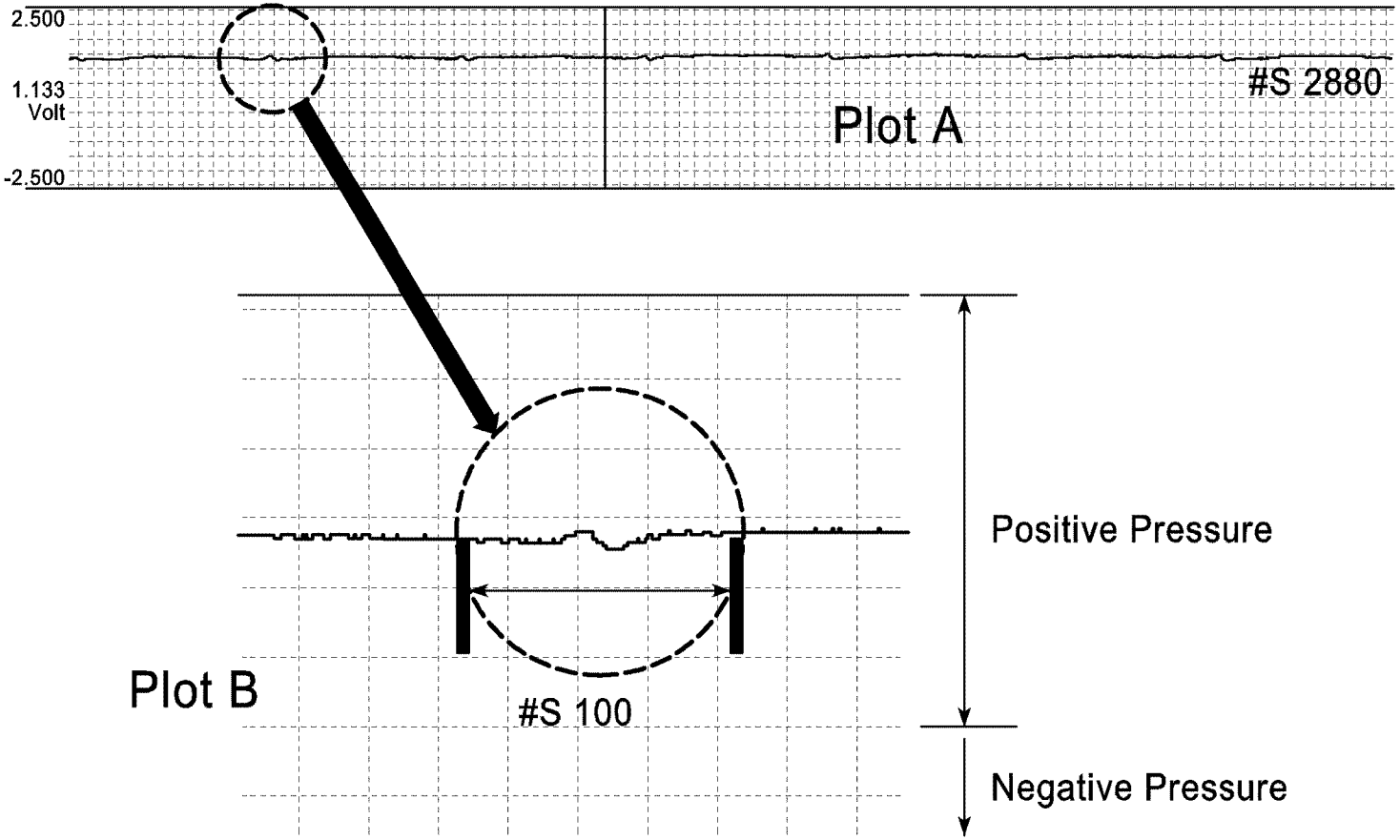

FIG. 3-1 is a representative view of the friction and drag forces imparted to the flexible tube in the metering pumps of the prior art. Most peristaltic pumps of the prior art use occluding members to reduce friction between occluded surface of tube and rolling elements. However, use of smaller size rollers or occluding shoes F still produce a large amount of rotational friction that drags the flexible tube from one side to another. This results in reduced lifetime of the tube due to tube shape change, stretch motion and friction. In the prior art pumps, the center of radial drive axis A drives drive arm E which make large radius B. This requires more force by the motor or other drive mechanism. Also drive arm E needs to be strong in order to transfer small radius to large radius rotational movement. Furthermore, a different rolling speed between large radius B and small radius S generates friction at the roller or shoe that produces a drag force D that drags the tube from one side to another. The pulsation angle W of the prior art peristaltic pump is larger than that of the present invention. This causes a large pulsation along with negative pressure, as shown in FIG. 4-2. It will be understood that in the metering pumps of the prior art, a small radius S need more force to drive large radius B as described, and also has roller or occluding shoes F which has small radial make heavy drive force D that caused by radial speed difference between two rolling mechanism.

FIG. 4 is a representative view showing the elimination pulsation from the dual-head, pulseless peristaltic-type metering pump 100 of the present invention. When shaft 8*a* is rotated by the motor or other rotational device, the inner roller element 7*a* in roller element assembly R1 and inner roller element 7*b* in roller element assembly R2 are rotated in the same direction as that of shaft 8*a*. 8*b*. This action causes transfer of a radial load from the center of shaft 8*a*, 8*b* to the outer race roller elements 5*a*, 5*b* through the ball bearings or other roller elements 6*a*, 6*b*. These actions create straight load forces 300*a*, 300*b* by linear occluding of the flexible tube 18 between the outer race roller elements 5*a*, 5*b* and the outer surface of flexible tube 18. The straight load force 300*a* at pump housing P1 and the straight load force 300*b* from center of shaft 8*a*, 8*b* are aligned at a 180 degree different phase between each other in pump housing P1 and pump housing P2.

As show best in FIG. 4, when the straight load force 300*a* is located within rotation angle 201*a*, the outer race roller element 5*a* occludes dual layer flexible tube 18 against dual occluding frame 11*a* in the first pump P1. At the moment of rotation angle 201*a*, flow from tube input 3*a* and from tube output 4*a* are stopped in pump P1, but rotation angle 201*b* in the pump housing P1 compensates for the volume of flow in pump housing P2. The peristaltic pump 100 of the present invention has a minimized width of dual occluding frame 11*a* below 1% out of one revolution where pulsation occurs. This results in a narrow pulse width due to the design of the input buffering spaces 9*a*, 9*b* and the output buffering spaces 10*a*, 10*b*. It will thus be understood that when shaft portions 8*a*, 8*b* rotate to CW, the straight load force 300*a* moves in rotation-angle 202, the outer race roller element 5*a* starts to occlude the single layer of flexible tube 18 due to design of outer buffering space 10*b*. This action generates a vacuum at tube input 3*a* to suck fluid in and push fluid to the tube output 4*a* by uniform flow volume output until the straight load force 300*b* reaches rotation angle 201*a*.

The straight load force 300*b* in the second pump P2 is at the 180 degree opposite position from the straight load force 300*a* in the first pump P1. This maintains uniform fluid flow by push and full operation at tube inputs 3*a*, 3*b* and tube outputs 4*a*, 4*b* until the straight load force 300*b* reaches the rotation angle 201*a*.

The improved peristaltic pump 100 of the present invention significantly reduced pulsation as follows: The narrow occluded position at dual layer tube 18 is located at rotation angle 201*a* where pulsation is generated. The input buffering spaces 9*a*, 9*b* and output buffering spaces 10*a* and 10*b* are in the main body 2. Non frictional design of the roller elements assemblies R1, R2 keep a uniform shape of the flexible tube 18 without changes in the volume of the tube 18. In the present invention, one main body 2 is comprised of two separate pumps P1, P2 assembled having 180 degree different phase where the residual pulsations caused by the 2 pumps P1 and P2 individually compensate and cancel each other. Another benefit provided by the buffering spaces 9*a*, 9*b*, 10*a* and 10*b* is relief of any accumulated tension in the flexible tube 18 when shafts 8*a*, 8*b* rotate one direction continuously, like most peristaltic pumps do.

Thus, the present invention reduces flexible tube 18 stretching and slipping, and allows longer tube 18 life. For example, as best shown in FIG. 4, when the straight load force 300*a* is moved to about the 3 o'clock position, the tube output 4*a* is free to move back to it's original shape and position. When the straight load force 300*a* moved to the 9 o'clock position, then the tube input 3*a* is free to move back to it's original shape.

FIG. 4-1 is a graphical illustration showing the elimination pulsation from the dual-head, pulseless peristaltic-type metering pump 100 of the present invention. FIG. 4-2 is a graphical illustration showing pulsation from the pumps of the prior art. As shown in FIG. 3-1, a prior invention used single loop type peristaltic pump but the pulsation width W is about 70 degrees out of one entire revolution of 360 degrees. This makes the pulsation period over 10% of one complete revolution of 360 degrees. The present invention makes a small rotation-angle 201*a* such that the pulsation width is below 1% of the complete 360 degrees as shown in FIG. 4.

In FIG. 4-1, the first pump P1 generates one pulse at the rotation angle 201*a* shown in FIG. 4, but the second pump P2 maintains the same volume of fluid output by occluding the single layer tube 18. As shown in the P1+P2 graph, the pulses generated at the rotation angle 201*a* compensate each other and reduce overall pulse. There is no pulse, but it has a small variation in output due to mechanical error.

As shown below, actual flow data proves the pump 100 of the present invention keeps positive flow without pulsation which does not stop flow or cause suck-back by negative pressure. It appear some draft by mechanical tolerance error.

As shown in FIG. 2, tube outputs 4*a*, 4*b* from the 2 pumps P1, P2 connected at the common output port manifold 16.

As shown in FIG. 4-2, the pulsation width W that is described with regard to FIG. 3-1, the prior art peristaltic pumps have about 70 degree pulsation angle. However, simple use of two pump housing without other mechanical design considerations will not generate a 180 degree different in phase of pulsation angle.

Figure 5:
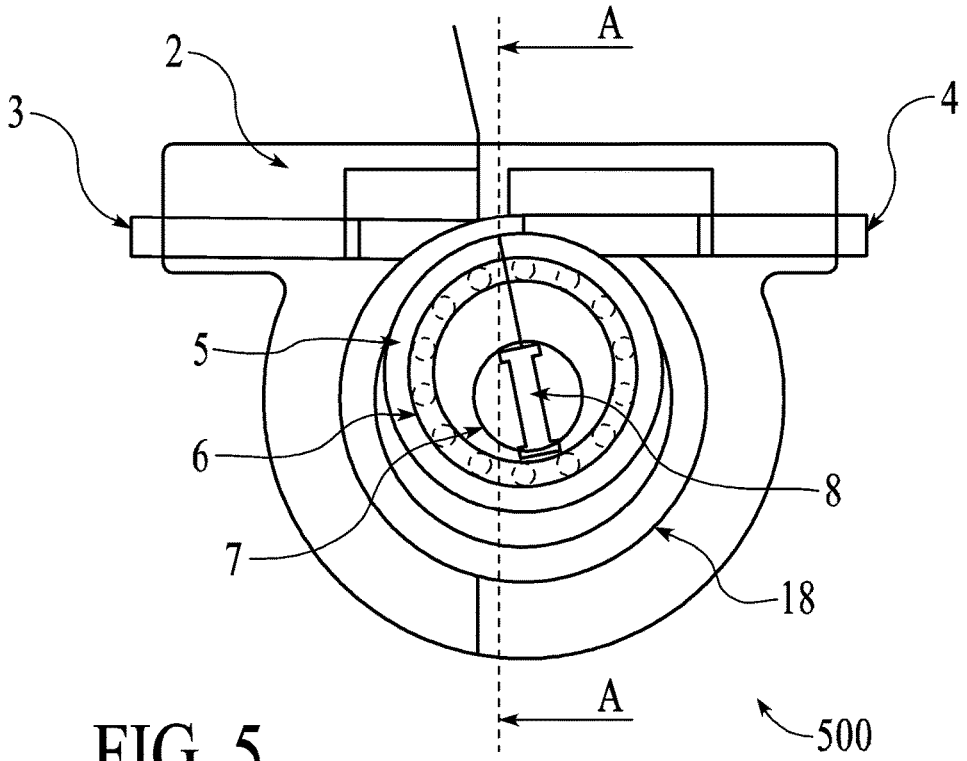
FIG. 5 is a front view of the single-head, pulseless peristaltic-type metering pump 500 of the present invention.
Figure 6:
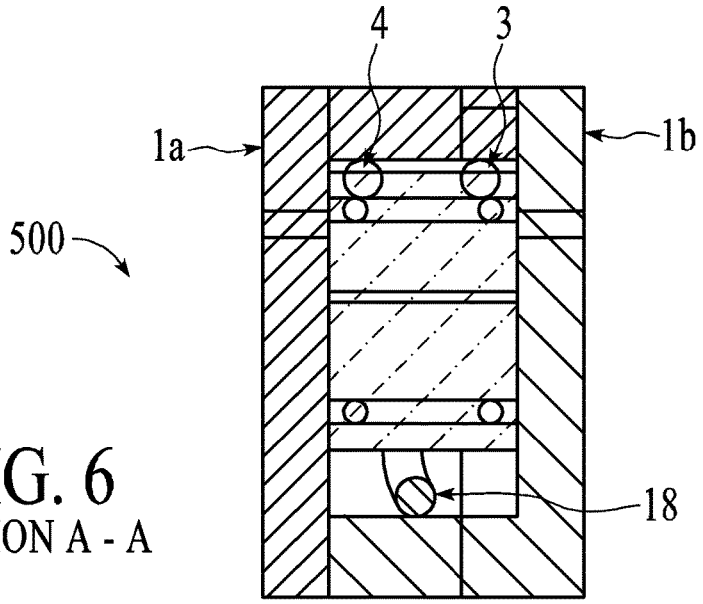
FIG. 6 is a side view of the single-head, pulseless peristaltic-type metering pump 500 of the present invention.
Figure 7:
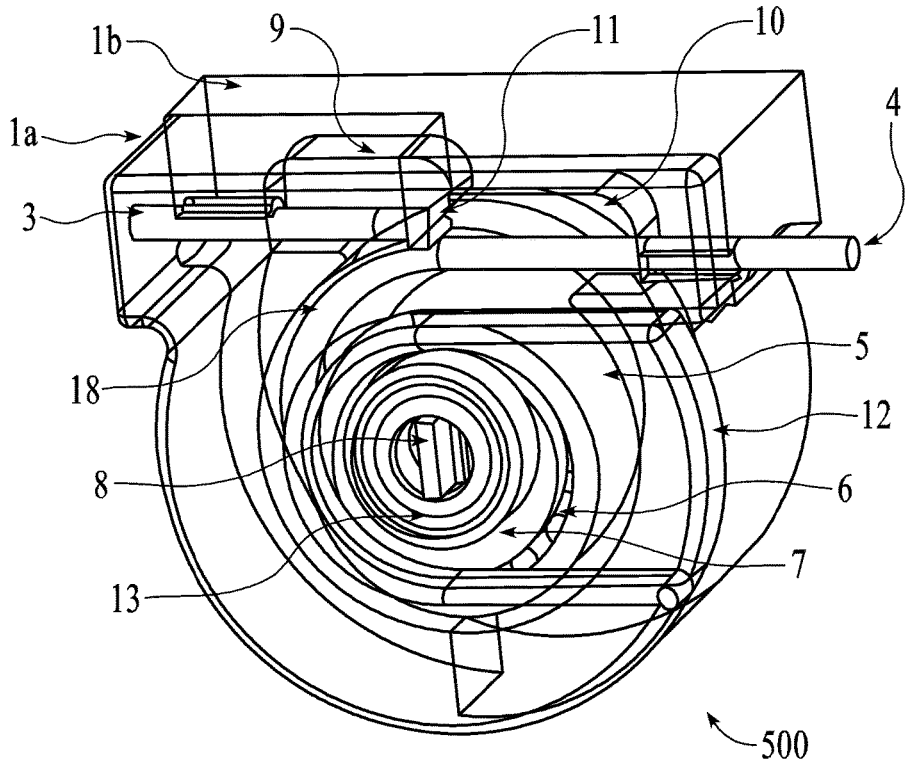
FIG. 7 is a perspective view of the single-head, pulseless peristaltic-type metering pump 500 of the present invention.

FIG. 5 is a front view of the single-head, pulseless peristaltic-type metering pump 500 of the present invention. FIG. 6 is a side view of the single-head, pulseless peristaltic-type metering pump 500 of the present invention. FIG. 7 is a perspective view of the single-head, pulseless peristaltic-type metering pump 500 of the present invention. Opposing cover portions 1*a* and 1*b* are designed with an L-shape and have half-round surfaces to guide the flexible tube 18. This L-shape design makes it easy to replace tube 18. Main body portion 2 has a single pumping chamber with input 3 and output 4. Input 3 and output 4 are stable, pulseless volumetric flow rate controlled.

Inner roller element 7, roller element ball bearings 6 and outer race roller elements 5 are made of ceramic, polyether ether ketone (PEEK) thermoplastic polymer or other comparable material having low thermal conductivity and amenable to application of a fine surface finish. These features of the inner roller element 7, ball bearings or other roller elements 6 and outer race roller element 5 improve the flexible tube 18 lifetime that by reducing damage caused by heat and friction between hose 18 and outer race roller elements 5*a*, 5*b*.

Center shaft 8 is designed with a combination of round and square shaped portions. This makes it easy to couple the assembly of inner rolling element 7, ball bearings or other roller elements 6 and outer rolling element 5. The center shaft 8 is driven by a single motor or other drive mechanism to rotate center shaft 8 in a clockwise (CW) or counterclockwise (CCW) direction. Flexible tube input port 3 and tube output port 4 are used as inlet or outlet, depending upon the rotation of shaft 8 in a CW or a CCW direction. Other elements and aspects of the dual-head, pulseless peristaltic-type metering pump 100 described above such as but not limited to shaft fastener bearings and bearing holding elements would also be used in the single-head pump 500.

The new design addresses the issues raised above that exist with prior art pumps by:

1. This invention minimizes the stress applied to the tube by eliminating rolling and drag motion across the tube with less stretching force applied to the tube. This is achieved by use of an outer ring setup and by using elongated tube channels that holds the tubing less rigidly than prior designs. The tube does not need to be held by rigid anchoring systems. The tube is routed through the pump with a flexible tension absorption section that allows the tube to move under roller contact and then return after the roller releases the tube section.

2. The roller design does not need lubrication.

3. The new head design incorporates a tube overlap areas 11*a*, 11*b* to allow constant tube 18 to roller 5*a*, 5*b* contact. Prior arts that use single loop design had issues at overlap area that stop flow caused pinched inputs 3*a*, 3*b* and outputs 4*a*, 4*b* at the same time. In the present design, overlap areas 11*a*, 11*b* are narrow pinched areas. Prior art pumps use of single loop design gives rise to issues caused by the overlap area that effectively stop flow caused as the tubing is pinched both in the input and output tube at essentially the same time. The present invention utilizes a narrow pinched area. This maintains constant tube pressure and minimizes pulsation time and magnitude of pulsation.

Figure 8:
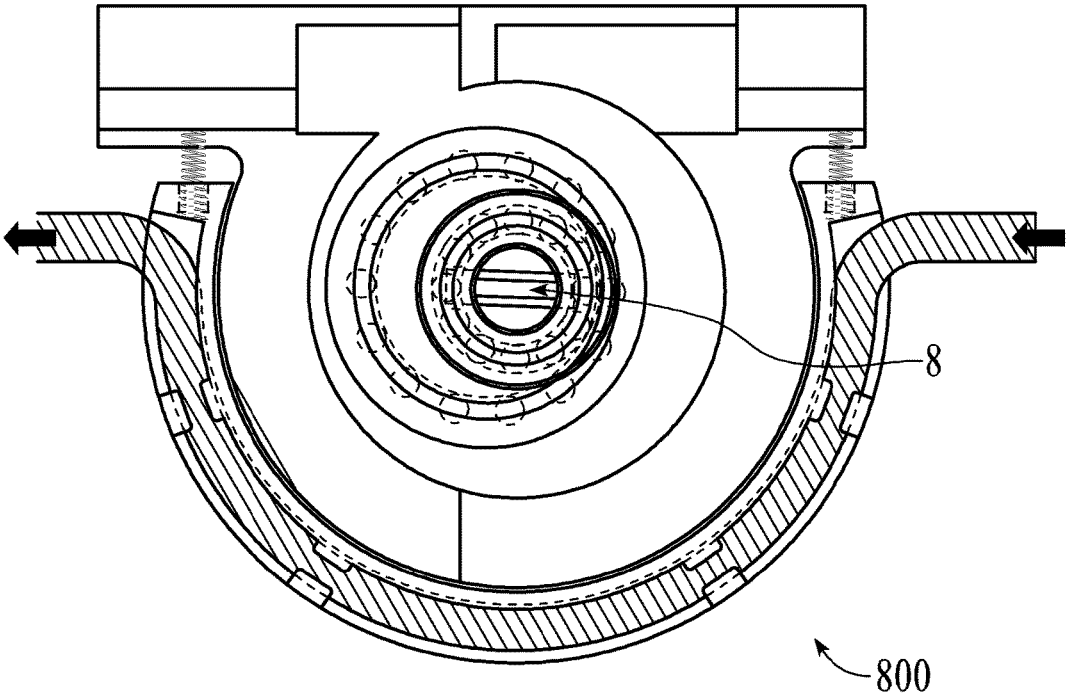
FIG. 8 is a perspective view of a different embodiment of the pulseless peristaltic-type metering pump 800 of the present invention.

4. The new design minimizes the change in tube diameter. Pump volumes are maintained for longer periods and pump calibration requirements are minimized FIG. 8 is a perspective view of a different embodiment of the pulseless peristaltic-type metering pump 800 of the present invention.

Experimental Results

FIG. 4-3 are the graphed results of experimental data collected from the dual-head, pulseless peristaltic-type metering pump 100 of the present invention. Plot A shows the raw data DC Voltage output signal collected for flow out. Data was collected every 50 msec by flow measurement test equipment. A total of around 3000 data points are shown in plot A. Plot B is a zoom into a portion of the graph of Plot A that shows 100 data points plotted on the graph, related to the residual pulsation area caused by mechanical tolerance/margin of error. Pulsation occurs where there is a switching of flow and no flow in a short period of time. As can be seen, there is no pulsation in the output of plot B and variation is minimal Unless defined otherwise, all technical and scientific terms used herein have the same meaning as commonly understood by one of ordinary skill in the art to which the present invention belongs. Although any methods and materials similar or equivalent to those described can be used in the practice or testing of the present invention, the preferred methods and materials are now described. All publications and patent documents referenced in the present invention are incorporated herein by reference.

While the principles of the invention have been made clear in illustrative embodiments, there will be immediately obvious to those skilled in the art many modifications of structure, arrangement, proportions, the elements, materials, and components used in the practice of the invention, and otherwise, which are particularly adapted to specific environments and operative requirements without departing from those principles. The appended claims are intended to cover and embrace any and all such modifications, with the limits only of the true purview, spirit and scope of the invention.

We claim:

1. A dual-head, pulseless peristaltic-type metering pump comprising:

a main body portion;

a drive shaft assembly extending longitudinally through the main body portion and having two drive shaft portions and a central common axis, two distal ends and at least one non-round portion;

a first pump head comprising:

an L-shaped cover portion;

a tube input, the tube input in conjunction with the L-shaped cover portion defining an input buffering space within which the tube is free to move, before being occluded by a roller element, and accumulated tension in the tube is relieved;

a tube output, the tube output in conjunction with the L-shaped cover portion defining an output buffering space unique from the input buffering space within which the tube is free to move and accumulated tension in the tube is relieved following occlusion by a roller element; and a roller element assembly comprising:

a round inner roller element having a non-round shaped, keyed opening that matches the at least one non-round portion of the drive shaft assembly, the round inner roller element mounted off-axis onto the at least one non-round portion of the drive shaft assembly, the inner roller element having an external surface;

a set of ball bearings disposed around the inner roller element in contact with the external surface thereof; and a round outer race roller element having an inner surface and an external surface, the outer race roller element encircling and containing the set of ball bearings such that as the drive shaft assembly is rotated, the inner roller element rotates off axis, the round, outer race element is stationary relative to a tube and radial rotation of the drive shaft assembly transfers a single linear occluding force to the tube adjacent the roller element assembly;

a second pump head comprising:

an L-shaped cover portion;

a tube input, the tube input in conjunction with the L-shaped cover portion defining an input buffering space within which the tube is free to move, before being occluded by a roller element, and accumulated tension in the tube is relieved;

a tube output, the tube output in conjunction with the L-shaped cover portion defining an output buffering space unique from the input buffering space within which the tube is free to move and accumulated tension in the tube is relieved following occlusion by a roller element; and a roller element assembly comprising:

a round inner roller element having a non-round shaped, keyed opening that matches the at least one non-round portion of the drive shaft assembly, the round inner roller element mounted off-axis onto the at least one non-round portion of the drive shaft assembly, the inner roller element having an external surface;

a set of ball bearings disposed around the inner roller element in contact with the external surface thereof; and a round outer race roller element having an inner surface and an external surface, the outer race roller element encircling and containing the set of ball bearings such that as the drive shaft assembly is rotated, the inner roller element rotates off axis, the round, outer race element is stationary relative to a tube and radial rotation of the drive shaft assembly transfers a single linear occluding force to the tube adjacent the roller element assembly;

a first full loop 360 degree tube path defined by the main body portion and L-shaped cover portion of the first pump head, the first tube path extending from the tube input of the first pump head, encircling the round outer race element of the first pump head and leading to the tube output of the first pump head within the output buffering space of the first pump head;

a second full loop 360 degree tube path defined by the main body portion and L-shaped cover portion of the second pump head, the second tube path extending from the tube input of the second pump head, encircling the round outer race element of the second pump head and leading to the tube output of the second pump head within the output buffering space of the second pump head, wherein occlusion points for the first and second pump heads are out of phase by 180 degrees;

a common input port tubing manifold coupling flow from a single fluid source to the separate tube inputs of each of the first and second pump heads; and a common output port tubing manifold coupling flow from the tube outputs of each of the first and second pump heads to a single fluid output; wherein when the at least one non-round portion of the drive shaft assembly is placed within both the non-round shaped, keyed opening of the inner roller element of the first pump head and the non-round shaped, keyed opening of the inner roller element of the second pump head, the inner roller element of the first pump head and the inner roller element of the second pump head are both mounted off-axis onto the drive shaft assembly out of phase by 180 degrees with respect to each other such that the combined output of the first pump head and the second pump head is pulse-less with minimal variation.

2. The dual-head, pulseless peristaltic-type metering pump of claim 1, further comprising a set of shaft fastener bearings distributed circumferentially around the drive shaft assembly at each of the first pump head assembly and the second pump head assembly.

3. The dual-head, pulseless peristaltic-type metering pump of claim 2, further comprising a bearing holding element holding in place the shaft fastener bearings distributed circumferentially around the drive shaft assembly at each of the first pump head assembly and the second pump head assembly.

4. The dual-head, pulseless peristaltic-type metering pump of claim 1, in which a minimal occlusion pulse width is less than 1% of an entire revolution.

5. The dual-head pulseless peristaltic-type metering pump of claim 1, wherein the shape of the at least one non-round portion of the drive shaft assembly matches the shapes of the non-round, keyed openings of the inner roller element of each of the first and second pump heads, wherein the at least one non-round portion of the drive shaft assembly and the non-round keyed openings are rectangular.

* * * * *